US007086892B2

(12) United States Patent
Tanacan et al.

(10) Patent No.: US 7,086,892 B2
(45) Date of Patent: Aug. 8, 2006

(54) LIVE CIRCUIT INDICATOR FOR PLUGS AND RECEPTACLES

(75) Inventors: Mehmet K. Tanacan, Farmingdale, NY (US); Alfredo Arenas, Hauppauge, NY (US); Leslie Lindenstraus, New York, NY (US); Eusebio Brinas, Belleville, NJ (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/777,193

(22) Filed: Feb. 13, 2004

(65) Prior Publication Data

US 2005/0037661 A1 Feb. 17, 2005

Related U.S. Application Data

(60) Provisional application No. 60/450,961, filed on Feb. 28, 2003.

(51) Int. Cl.
*H01R 3/00* (2006.01)

(52) U.S. Cl. ..... 439/490
(58) Field of Classification Search ..... 439/490
See application file for complete search history.

(56) References Cited

U.S. PATENT DOCUMENTS

| | | | | | |
|---|---|---|---|---|---|
| 4,111,516 | A * | 9/1978 | Wireman | 439/490 |
| 4,298,864 | A * | 11/1981 | Mahnke et al. | 340/657 |
| 4,318,578 | A * | 3/1982 | Ericson et al. | 439/106 |
| 4,500,160 | A * | 2/1985 | Bertsch | 439/56 |
| 4,606,597 | A * | 8/1986 | Bielefeld | 439/490 |
| 4,671,597 | A * | 6/1987 | Grill | 362/253 |
| 5,244,409 | A * | 9/1993 | Guss et al. | 439/490 |
| 5,409,398 | A * | 4/1995 | Chadbourne et al. | 439/490 |
| 5,567,175 | A * | 10/1996 | Warden et al. | 439/490 |
| 6,802,741 | B1 * | 10/2004 | Shatkin | 439/620 |
| 6,827,602 | B1 * | 12/2004 | Greene et al. | 439/490 |

* cited by examiner

*Primary Examiner*—Ross Gushi
(74) *Attorney, Agent, or Firm*—Paul J. Sutton

(57) ABSTRACT

An electrical connector, such as one for receiving a plug, having at least two prongs for insertion into the connector, and having an electrical cable connected to the prongs of the plug and the connector in the usual way, includes a series circuit having an LED. The LED is located within the connector behind a window, and light from the LED provides a visual indication to a user that the connector is connected to a live circuit. The series circuit is located in a module that can be pre-assembled before being located within the connector and, when in the connector, the series circuit is electrically coupled directly to the contacts in the connector by means of spring contacts located in passageways in the module. Indexing means is provided for aligning the LED in the module with the window in the connector to insure that a user can see if the LED is on or off.

11 Claims, 9 Drawing Sheets

LIVE CIRCUIT INDICATOR FOR PLUGS AND RECEPTACLES

CROSS-REFERENCE TO RELATED APPLICATIONS

This application claims priority pursuant to 35 U.S.C. 119(e) from U.S. Provisional Patent Application having application No. 60/450,961, filed Feb. 28, 2003.

BACKGROUND OF THE INVENTION

Field

This invention relates generally to electrical connectors and more particularly to a means for indicating that the contacts of a plug or connector are electrically connected to a live source of power.

Extension cords, particularly those that are made by a user by connecting a connector and a plug to the ends of a cable having a specific length and sized to carry a maximum current, are typically used both indoors and outdoors to provide electrical power for either a general purpose or a specific use. For example, when used as a general purpose conductor, the extension cord may be used to supply power to a lamp, a portable work light, a power tool, a surge protector such as is used to power a computer, a window mounted air conditioner, etc. When the extension cord is used outside, it may be used to supply power, on a temporary or semi-temporary basis, such as to a boat moored at a boat slip. In each instance, when an extension cord is first connected to a load, the user must usually trace the conductor back to the plug to make sure that it is plugged into a receptacle. However, at this time, the user has no indication that the extension cord is connected to a receptacle that is connected to a live source of power. Therefore, what is needed is a connector, which can also be a plug, that can indicate if it is connected to a live source of power. Additionally, the connector should look like a standard connector and be wired to a conductor in the same way that a regular connector is wired.

SUMMARY OF THE INVENTION

The present invention relates to a method and apparatus for indicating that the line contacts of a connector are electrically connected to a live source of power. In the invention, a live circuit indicator module has an LED/resistor/diode series circuit connected between the tops of the line contacts of a connector or prongs of a plug to indicate if the prongs or contacts are connected to a live source of power. In operation, the LED of the series circuit shows by glowing that the prongs of a plug or contacts of a connector are actually connected to a live source of power.

In this invention, the electrical device, such as a plug, has at least two blades or prongs for insertion into a receptacle or connector. An electrical cable having at least two line conductors and a ground conductor extends into the housing of the plug and is connected directly to the blades of the plug. A live circuit indicator module is located within the plug for indicating, by means of a light, such as an LED, that the line prongs of the plug are connected to a live source of power. The housing includes at least one opening located adjacent to the light source located within the plug to provide a visual indication to a user that the prongs are connected to a live source of power. As used herein, the term live source of power is understood to mean that the prongs are connected to a source of potential of, for example, 120V, 240V, more or less, etc.

The module for indicating that the prongs are connected to a live source of power is self contained, can be pre-assembled and is located within the plug to become an integral part of the plug before the prongs of the plug are connected to the electrical line conductors. The series circuit of the live circuit indicator module is electrically coupled to the prongs by means of springs which are located in passageways in the module and the back cover to connect the LED/resistor/diode series circuit in the module directly to the prongs of the plug. The springs extend through the insulating body member of the module in which the series circuit is located. In operation, when the prongs of the plug are connected to a source of potential, the LED will glow. In the absence of a potential on the prongs of the plug, the LED will not glow. Thus, with this invention, a user can readily determine if power is being applied not just to the plug, but to the blades of a plug by looking for the light in the plug. If the LED is lit, then the prongs of the plug are connected to a live source of power.

The live circuit indicator module does not alter the way the connector (or plug) is wired. A connector (or plug) with the live circuit indicator module, here disclosed, looks the same and is wired the same way as a connector (or plug) which does not have a live circuit indicator module.

The housing of the plug contains alignment means for positioning the light emitting means next to an opening in the cover of the plug to insure that a user can see if the light emitting means is on or off.

With this invention a user can readily determine if power is being applied to the contacts of a plug or connector by looking for a light in the window of the plug.

This invention has been described in relation to a form of electrical connector, it being understood however, that other types of electrical connectors such as electrical receptacles, screw type connectors or any similar form of electrical connector may utilize the live circuit indicator module here disclosed. Further, it is to be understood that this invention can be used with two line (hot and neutral) conductor cables for determining if a plug or a connector is connected to a live source of power.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiments as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features and advantages of the present invention will become more fully apparent from the following detailed description, the appended claims and the accompanying drawings in which similar elements are given similar reference numerals.

DETAILED DESCRIPTION

Figure 1:
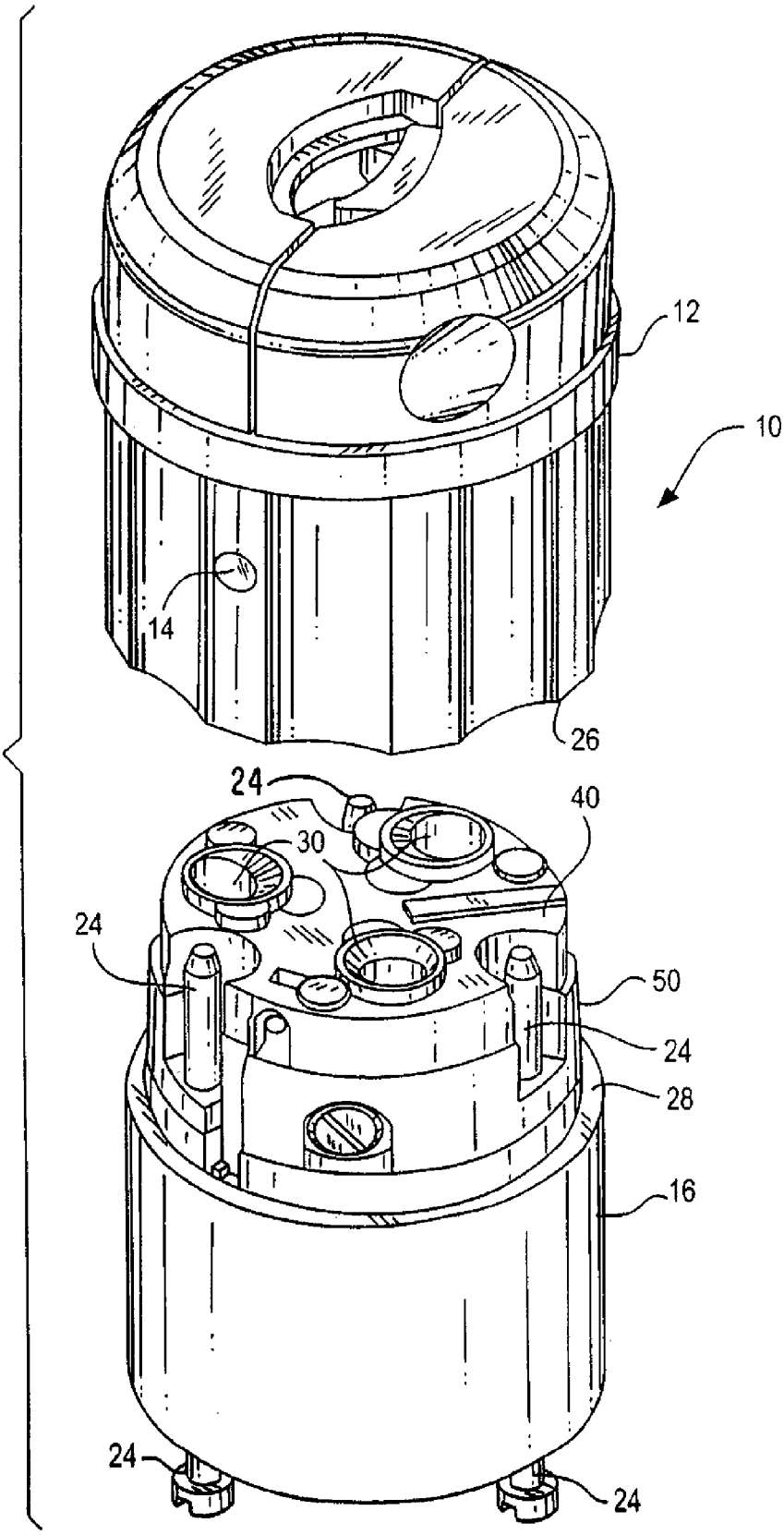
FIG. 1 is an exploded perspective view of one form of electrical connector incorporating a live circuit indicator module for indicating if the contacts of a connector are connected to a live source of electrical power in accordance with the principles of the invention.

FIG. 1 shows an exploded perspective view of one form of an electrical connector within which is a live circuit indicator module for indicating the presence of electrical power at the contacts in accordance with the principles of the invention. The connector 10 has a cover 12 adapted to be positioned over the top and secured firmly to the body 16 with screws 24. The connector supports a pair of line contacts and a ground contact (not illustrated). In the case of a plug, prongs extend outward from the bottom surface of the plug to provide a standard three blade grounded plug. Power is supplied to the plug or connector by a three wire cable (not illustrated) having two line conductors and a ground conductor which extend into the cover and connect to the line contacts/blades and the ground contact/blade. A clamping means is provided to hold the three wire cable in position relative to the connector.

In accordance with the principles of invention, at least one window opening 14 is provided in the cover 12. The window extends into the hollow interior of the cover. A light generating means such as an LED located in a live circuit indicator module is positioned behind the window and is visible through the window opening 14.

The wires of the conductor are stripped of insulation at the ends and are inserted into the openings 30 for attachment to the contacts of the connector. The inward end of each line contact includes a connection screw and a clamp assembly for securing a conductive lead wire in electrical contact with the contact. In a similar manner, the inward end of the ground contact includes a screw and clamp assembly for connecting a ground lead wire thereto. Insertion of the wires into openings 30 and clamping the wires to the contacts electrically connects each wire to a contact of the connector.

Figure 2:
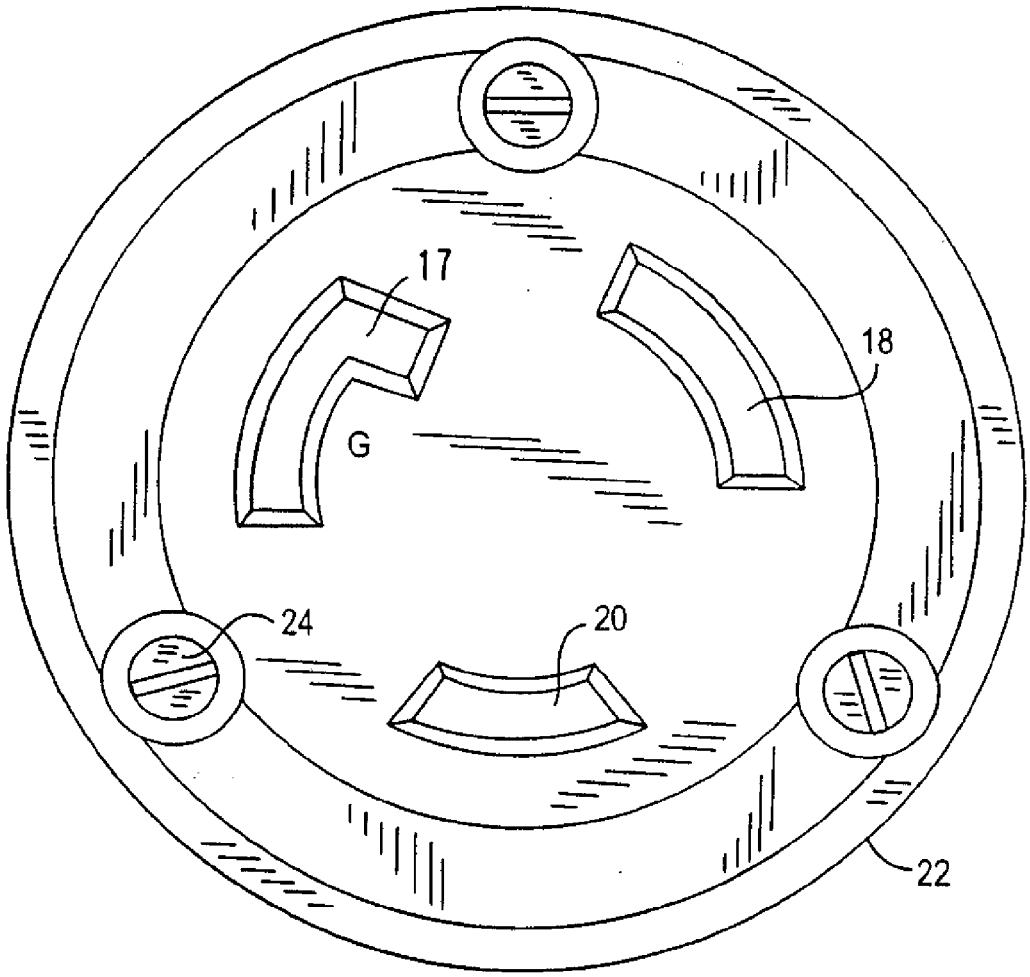
FIG. 2 is a bottom view of the connector of FIG. 1 showing the ground opening and the two line openings.

Referring to FIG. 2, there is illustrated a bottom view of the connector of FIG. 1 showing three openings. Behind opening 17 is the ground contact and behind openings 18 and 20 are the line contacts. Three screws 24, see FIG. 1, extend from the bottom surface through the body 16 of the connector to engage the cover 12. Tightening the screws 24 locks the cover 12 to the body 16 where the lower edge 26 of the cover engages the upper edge 28 of the body of the connector. Alignment means is provided to align the cover with the body and the window in the cover with the LED of the live circuit indicator module.

When the cover is positioned over the top portion of the body, live circuit indicator module 40 and back cover 50 of the plug are located within the cover (FIG. 1).

Figure 3:
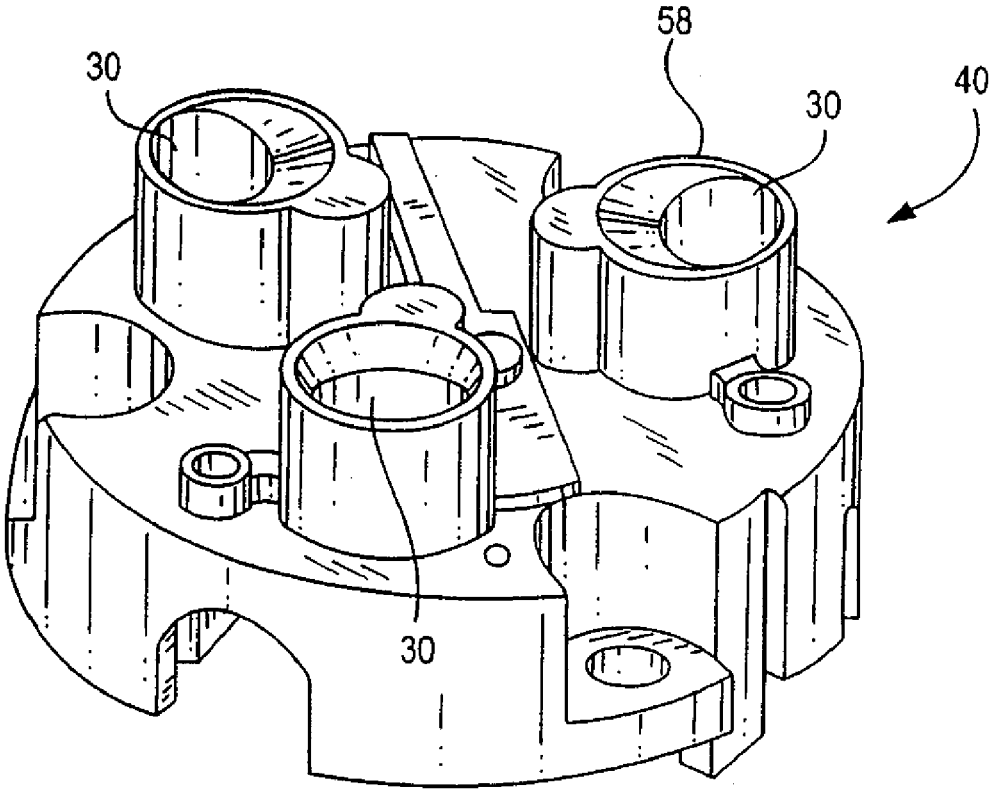
FIG. 3 is a perspective view of the back cover of the connector which is located above the contacts of the connector and below the live circuit indicator module.

FIG. 3 is a perspective view of the back cover 40 of the connector. The openings 30 are sized to receive the conducting wires of the cable which supplies power to the contacts of the connector. The back cover has two passageways for receiving springs. The openings are positioned to be in alignment with the top of the connector which is connected to the line conductors and with the conductive pads 52, 54 (see FIG. 4) of the LED/resistor/diode circuit located in the live circuit indicator module when the live circuit indicator module is positioned onto the top of the back cover.

Figure 4:
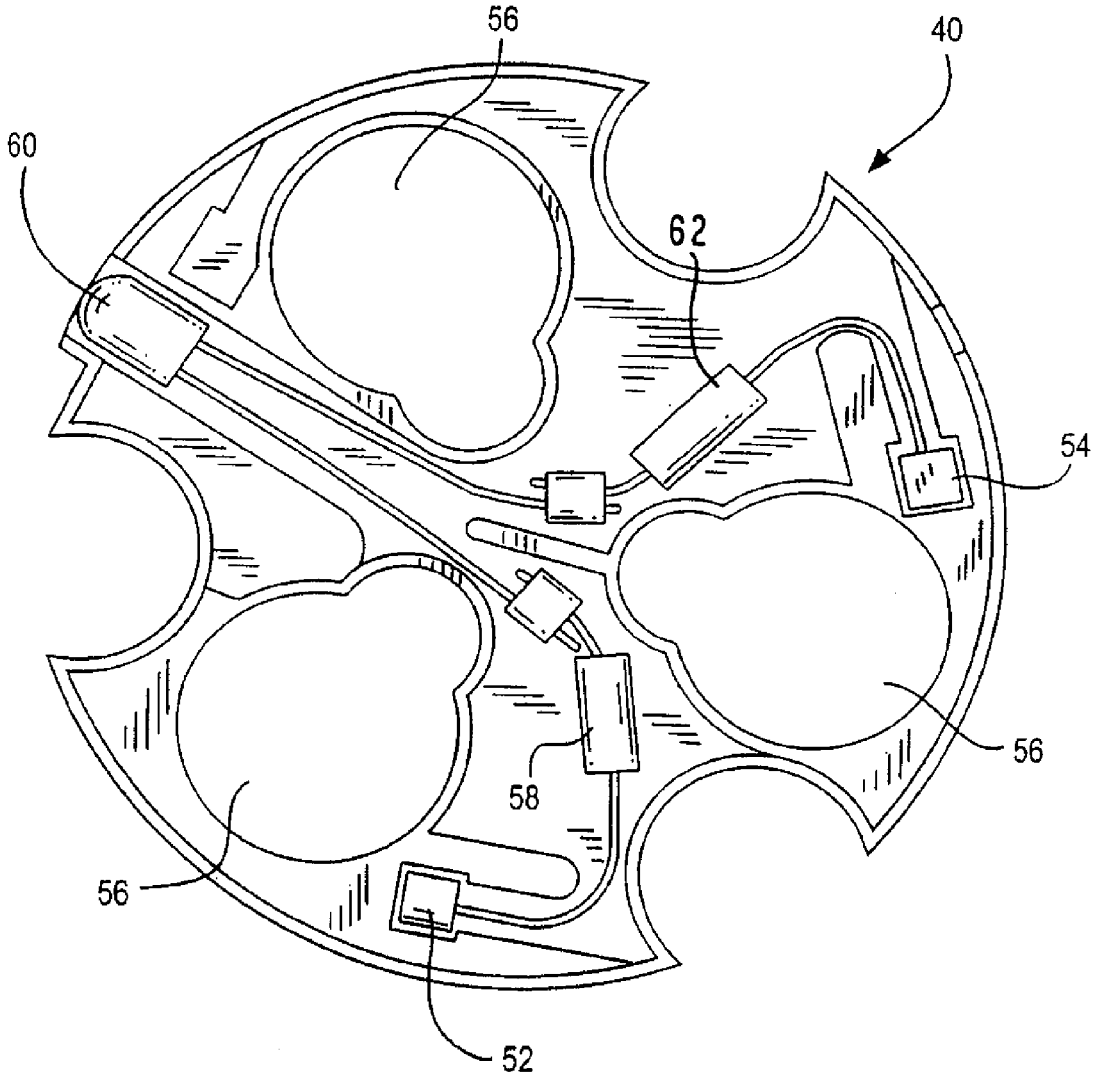
FIG. 4 is a top view of the live circuit indicator module showing the series circuit for indicating if the contacts of the connector are connected to a live source of electrical power.

Referring to FIG. 4, there is shown the top view of the live circuit indicator module 40. The module has three openings 56 sized to receive the projections 58 (see FIG. 3) into which the conducting wires of the cable are located. Located on the top surface of the module 40 is the series circuit for detecting the presence or absence of power at the contacts of the connector. The circuit comprises a conductive pad 52 connected to a diode 58, an LED 60, a resistor 62 and a second conductive pad 54, all connected in series. The LED is positioned to be aligned with and located behind the window 14 in the cover when the connector is assembled. The pads 52, 54 are positioned to be in alignment with the top of the passageways in the back cover which contain the springs. When the live circuit indicator module is positioned on top of the back cover, the conductive pads 52,54 make electrical contact with the tops of the two contacts connected to the line conductors by means of springs located within the openings in the back cover. Thus, a series circuit is established from the top of one line connected contact through pad 52, diode 58, LED 60, resistor 62, and pad 54 to the top of the other line connected contact.

In operation, the LED is on when power is applied to the line connected contacts, and the LED is off when the line connected contacts are not connected to a live source of power. Thus, with this invention, a break in either of the line conductors will be indicated by the off state of the LED.

Figure 5:
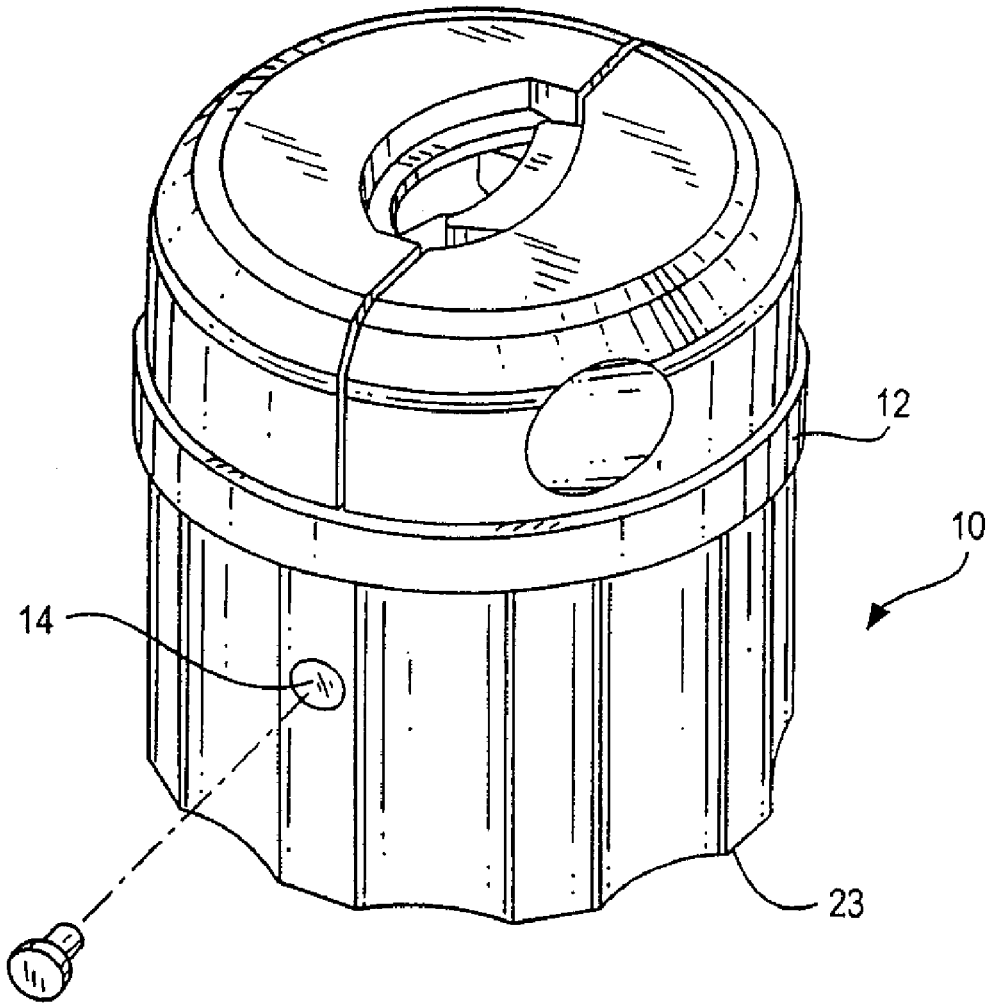
FIG. 5 is a perspective view of the cover of the top portion of the connector.

Referring to FIG. 5 there is shown a perspective view of the top portion of cover 12 of the plug or connector. The cover contains a window 14 which is aligned to allow light from the LED to pass through for viewing by a user. A clear or colored lens can be positioned in the opening to prevent moisture and dirt from entering the interior and better allowing a user to see if the LED is on or off. If desired, the lens can be colored green or red or another color to emphasize the state of operation (conductivity) of the plug or connector. The top of the cover supports a cable clamp to prevent the cable from being pulled out.

Figure 6:
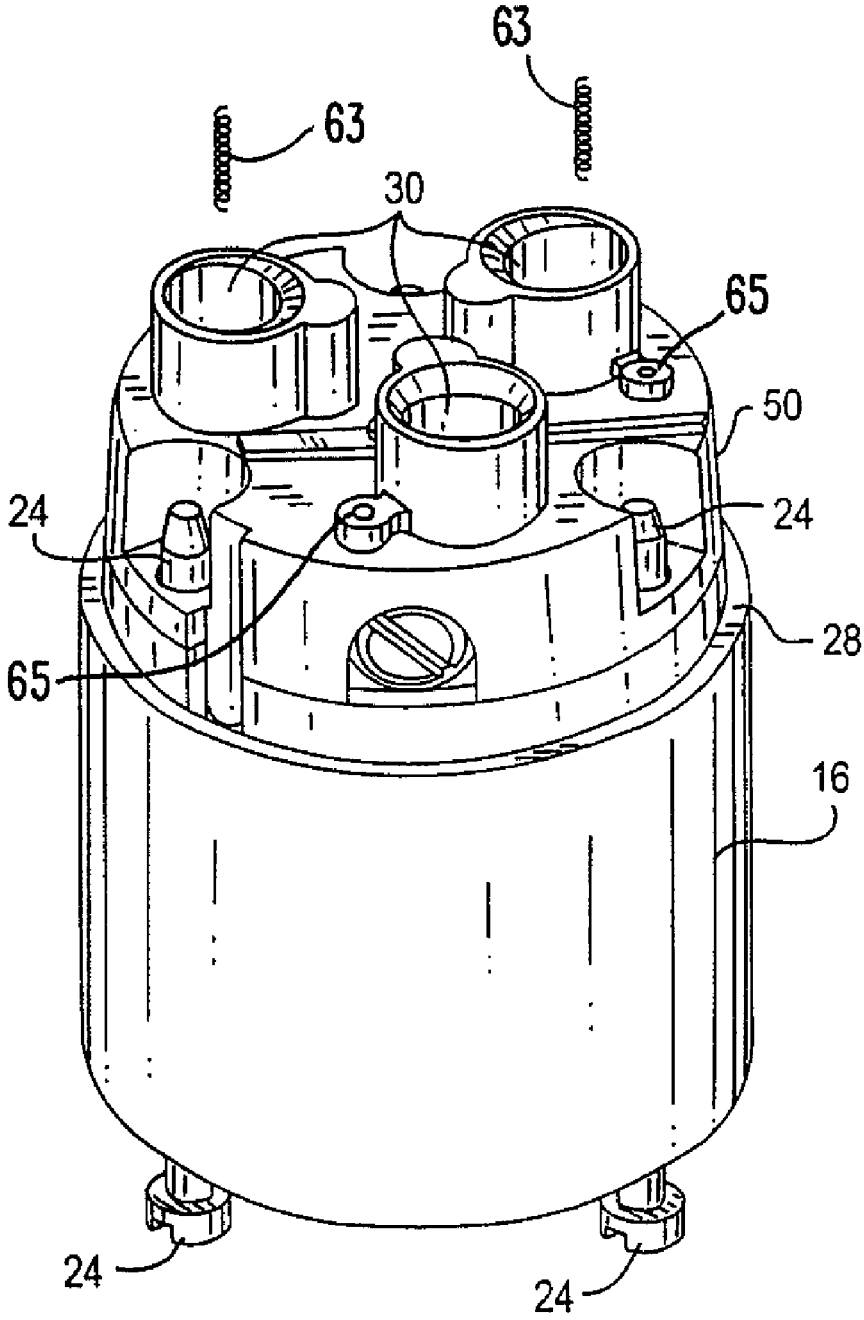
FIG. 6 is a perspective view of the lower portion or body of the connector showing spring contacts about to be placed into passageways in the back cover to make electrical contact with the tops of the line contacts that are to be connected to line conductors.

FIG. 6 is a perspective view of the body of the connector without the live circuit indicator module and the cover and showing the two springs 63. Springs 63 are located in the passageways 65 of the back cover to electrically connect the conductive pads 52, 54 to the tops of the contacts of the connector that are connected to the line conductors.

Figure 7:
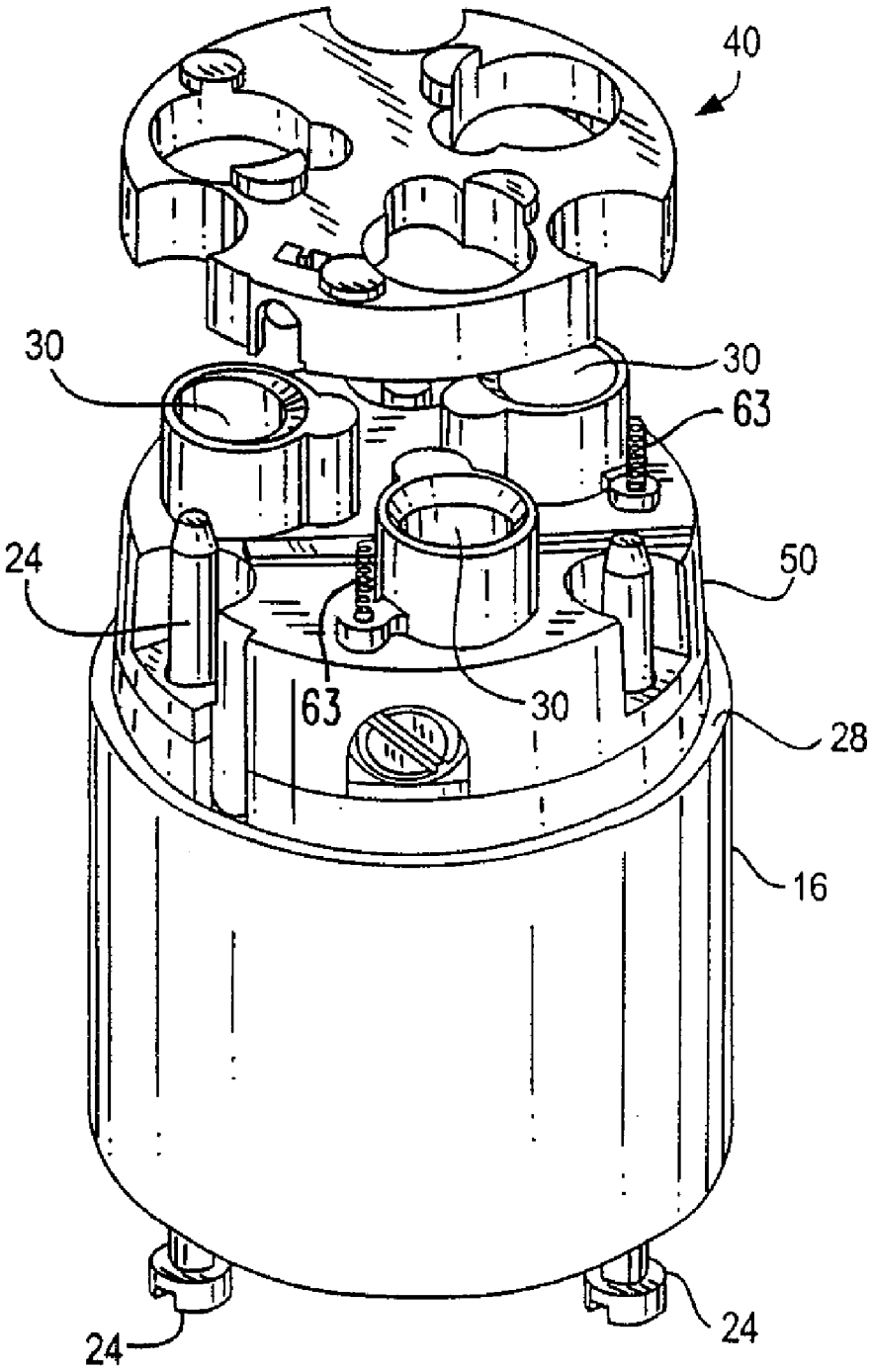
FIG. 7 is a perspective partially exploded view showing how the live circuit indicator module fits on the top of the back cover.

FIG. 7 is a perspective partially exploded view showing the live circuit indicator module about to be positioned on the top of the back cover. The back cover and the live circuit indicator module have alignment means to insure that the springs 63 make electrical contact with the tops of the contacts of the connector that will be connected to the line conductors. The same or another alignment means also insures that the LED will be in alignment with and located behind the window in the cover when the cover is attached to the body of the connector to permit light from the LED to be seen by a user.

Figure 8:
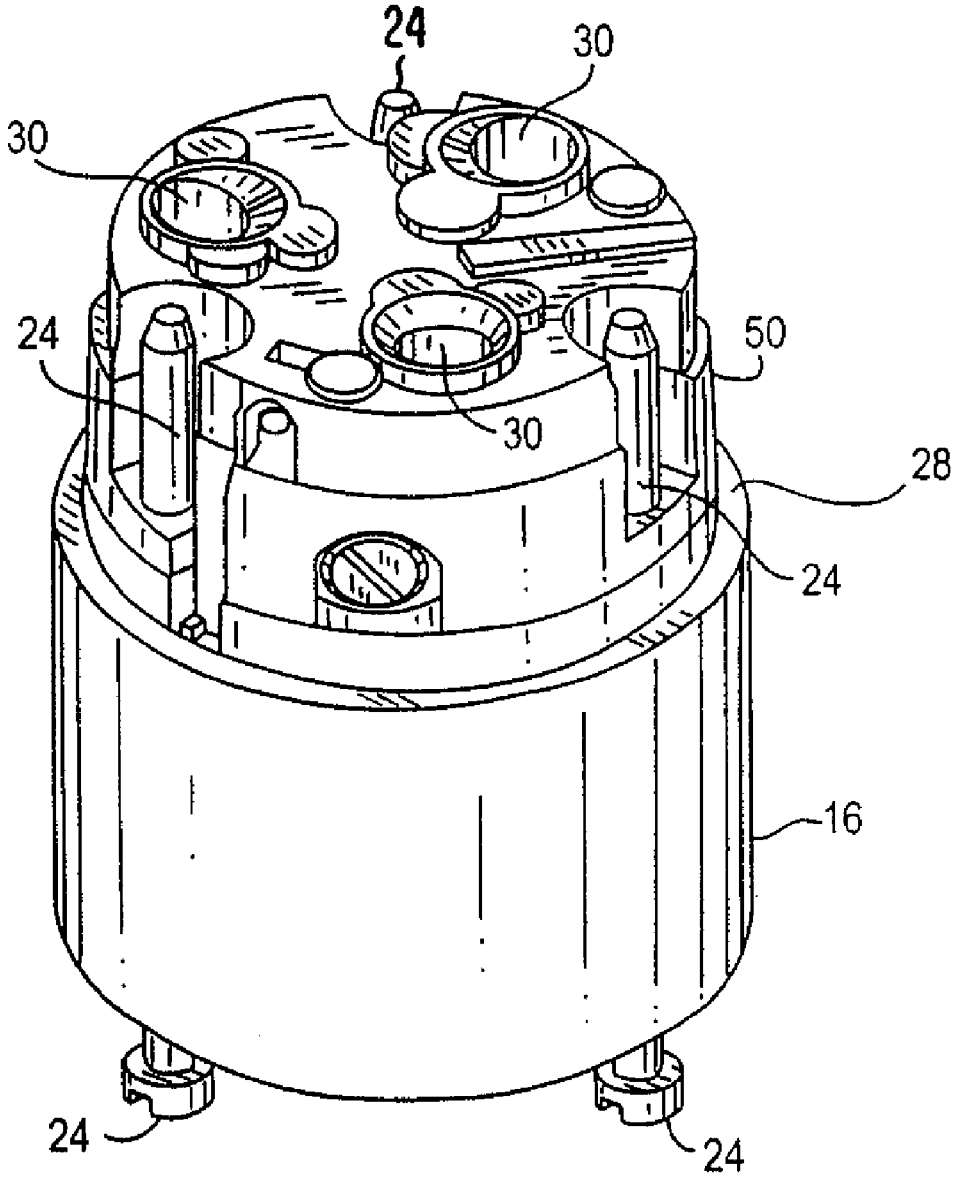
FIG. 8 is a perspective view of the body of the connector including the live circuit indicator module ready for positioning within the cover.

FIG. 8 is a perspective view of the body of the connector showing the live circuit indicator module in position on top of the back cover. The live circuit indicator module can be heat staked to the back cover or held in place by screws, epoxy or the like.

Figure 9:
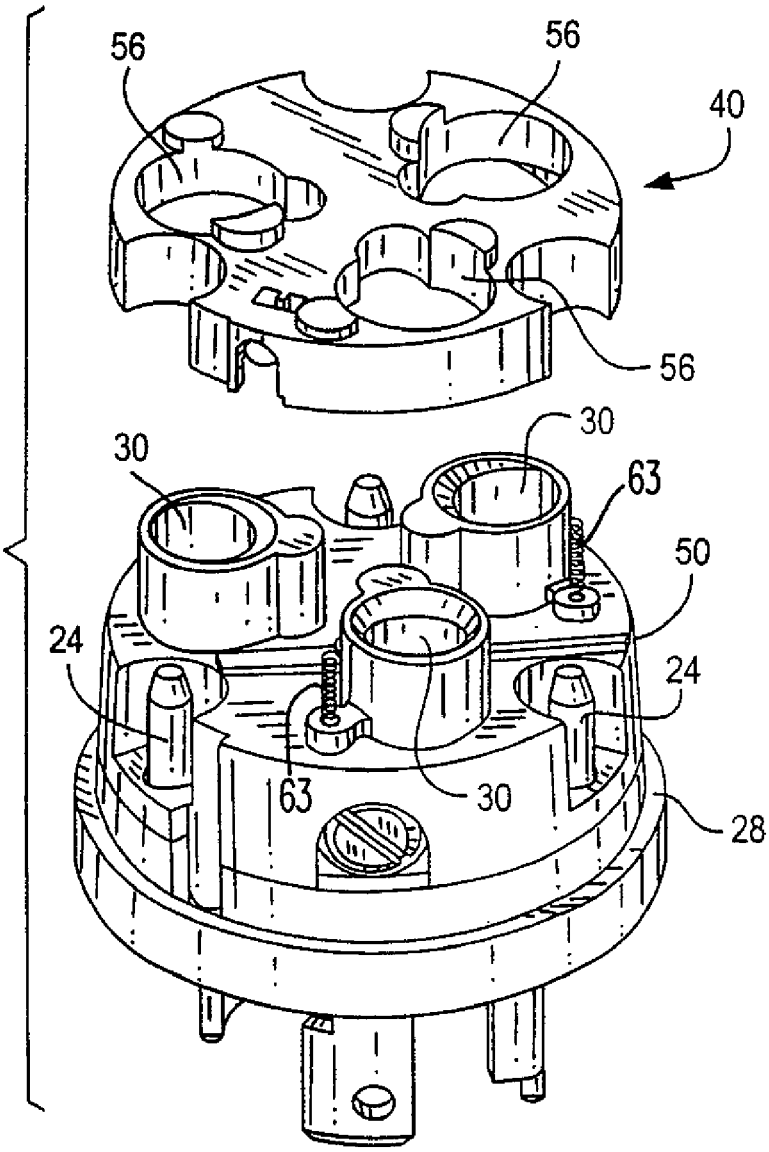
FIG. 9 is an exploded perspective view of the body of the plug showing the two springs about to be inserted into openings in the back cover to provide a conductive path between the prongs of the plug and the circuit in the live circuit indicator module.

FIG. 9 is an exploded perspective view of the body of the plug showing the two springs prior to being inserted into the passageways in the back cover to make contact with the tops of the prongs which are to be connected to the line conductors. Thereafter, the live circuit indicator module is placed on top of the back cover and, by means of alignment means, the conductive pads 52, 54 are located to make contact with the tops of the springs to electrically connect the series circuit of the live circuit indicator module across the two prongs of the plug which are to be connected to the line conductors.

While there have been shown and described and pointed out the fundamental novel features of the invention as applied to the preferred embodiment, it will be understood that various omissions and substitutions and changes of the form and details of the method and apparatus illustrated in the operation may be done by those skilled in the art, without departing from the spirit of the invention.

What is claimed is:

1. An electrical connector comprising:

a first contact adapted to slidably engage a phase contact of a mating connector;

a second contact adapted to slidably engage a neutral contact of the mating connector;

a third contact adapted to slidably engage a ground contact of the mating connector;

a module of insulating material adapted to be coupled to the electrical connector; indexing means coupled to the module to orient the module relative to the electrical connector; and a series circuit having light emitting means having an on state and an off state supported by the module of insulating material and electrically coupled to said first and second contacts for indicating when said first and second contacts are connected to a live source of electrical power when slidably engaged to said mating connector by being in its on state, wherein the on and off state is independent of the connection of the third contact to the mating connector, wherein conductive springs made of coiled wire connect the ends of the series circuit to the first and second contacts.

2. The electrical connector of claim 1 wherein the first and second contacts are prongs of a male plug or contacts of a female connector.

3. The electrical connector of claim 2 wherein the module of insulating material is adapted to be located within the electrical connector and attached to a portion of the connector coupled to the prongs or contacts.

4. The electrical connector of claim 3 wherein the light emitting means comprises an LED.

5. The electrical connector of claim 4 wherein the series circuit further comprised a resistor and a diode in series with the LED.

6. The electrical connector of claim 5 wherein the series circuit is connected directly to the prongs of the plug or contacts of the connector.

7. The electrical connector of claim 5 further comprising a window located to allow light from the LED to pass therethrough.

8. The electrical connector of claim 7 wherein the conductive springs contact the top ends of the prongs or contacts.

9. The electrical connector of claim 7 further comprising a lens located in the window.

10. The electrical connector of claim 9 wherein the lens located in the window is clear.

11. The electrical connector of claim 9 wherein the lens located in the window is colored.

* * * * *